United States Patent [19]

Yu

[11] Patent Number: 5,037,456

[45] Date of Patent: Aug. 6, 1991

[54] ELECTROSTATIC PRECIPITATOR

[75] Inventor: Heui-Sang Yu, Seoul, Rep. of Korea

[73] Assignee: Samsung Electronics Co., Ltd., Kyunggi, Rep. of Korea

[21] Appl. No.: 591,149

[22] Filed: Oct. 1, 1990

[30] Foreign Application Priority Data

Sep. 30, 1989 [KR] Rep. of Korea ..... 89-14357

[51] Int. Cl.[5] ..... B03C 3/00

[52] U.S. Cl. ..... 55/137; 55/138; 55/151

[58] Field of Search ..... 55/136–138, 55/151

[56] References Cited

U.S. PATENT DOCUMENTS 3,026,964 3/1962 Penney ..... 55/137
4,056,372 11/1977 Hayashi ..... 55/152
4,381,927 5/1983 Noll ..... 55/151

*Primary Examiner*—Bernard Nozick
*Attorney, Agent, or Firm*—Cushman, Darby & Cushman

[57] ABSTRACT

An electrostatic precipitator comprising a corona discharging section for charging dust particles as they pass through and a dust collecting section which has at least two sets of negative plate electrodes for collecting the positively charged dust particles and auxiliary plate electrodes to accelerate the dust particles to the collecting plate electrodes. The collecting and auxiliary plate electrodes in each set are so alternately arranged that the arrangement of the collecting and auxiliary plate electrodes in one set is opposite to that in the adjacent sets whereby the positively charged dust particles passing through the dust collecting section can be effectively collected to the collecting plate electrodes to improve collecting efficiency and energy efficiency with mimized noise.

3 Claims, 2 Drawing Sheets

ELECTROSTATIC PRECIPITATOR

BACKGROUND OF THE INVENTION

1. Field of the Invention

This invention relates to an improved collecting plate electrode arrangement for use in a houshold electrostatic precipitator.

2. Description of the Prior Art

The conventional electrostatic precipitator includes, as shown in FIG. 1 of the drawings, an electrode assembly 10 comprising a plurality of latticed collecting plate electrodes 1 and 2 arranged upright facing in the direction of air flow as indicated by the arrows. In this prior art, high noise levels were created and the energy efficiency was low because of the lattice structure of collecting plate electrodes obstructing the air flow in the electrode assembly.

Some improvements in reducing the noise and enhancing the energy efficiency have been achieved by an electrostatic precipitator of the sort disclosed by U.S. Pat. Nos. 4,056,372 and 4,381,927. Such an electrostatic precipitator has a dust collecting section that comprises a pack of parallel and equally spaced plates suspended so they are parallel to the direction of air flow through the dust collecting section. However, collecting efficiency remained a distinct problem.

SUMMARY OF THE INVENTION

In accordance with the present invention, the electrostatic precipitator comprising a corona discharging section including a plurality of negative collecting plate electrodes and positive corona discharge electrodes arranged such that a corona discharge electrode is disposed between two adjacent negative collecting plate electrodes, and a dust collecting section including at least two sets of negative collecting plate electrodes and positive plate electrodes disposed equally spaced and parallel to the direction of air flow.

Dust particles, as they pass through the corona discharging section, are positively charged and then migrated to the negative collecting plate electrodes in the dust collecting section. The negative and positive plate electrodes in each set of the dust collecting section are arranged alternately and in parallel with each other. The positive plate electrodes serve to accelerate the positively charged dust particles to the collecting plate electrodes. The sets of plate electrodes in the dust collecting section are so arranged that the positioning of the negative and positive plate electrodes in one set is opposite to that of adjacent sets, whereby the positively charged dust particles may pass through the dust collecting section with a wave motion under action of the attraction force of thenegative collecting plate electrodes and exclusion force of the positive plate electrodes to improve the dust collecting efficiency with minimal noise.

Therefore, an object of the invention is to provide an electrostatic precipitator whose collecting efficiency and energy efficiency are improved over the prior art apparatus.

BRIEF DESCRIPTION OF THE DRAWINGS

The invention will be described further with reference to the accompanying drawings, in which.

DESCRIPTION OF THE PREFERRED EMBODIMENT

Figure 1:
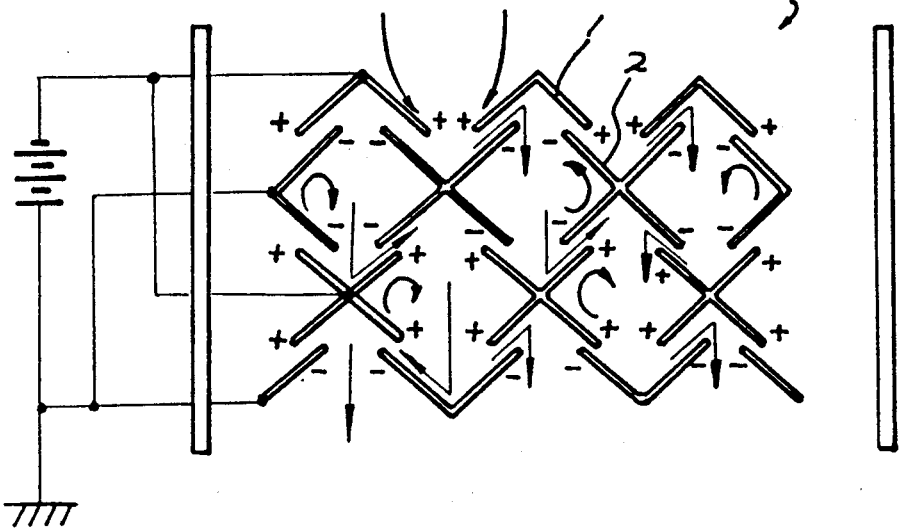
(PRIOR ART) FIG.1
FIG. 1 is a schematic view of the collecting plate electrode assembly of a prior art electrostatic precipitator.
Figure 2:
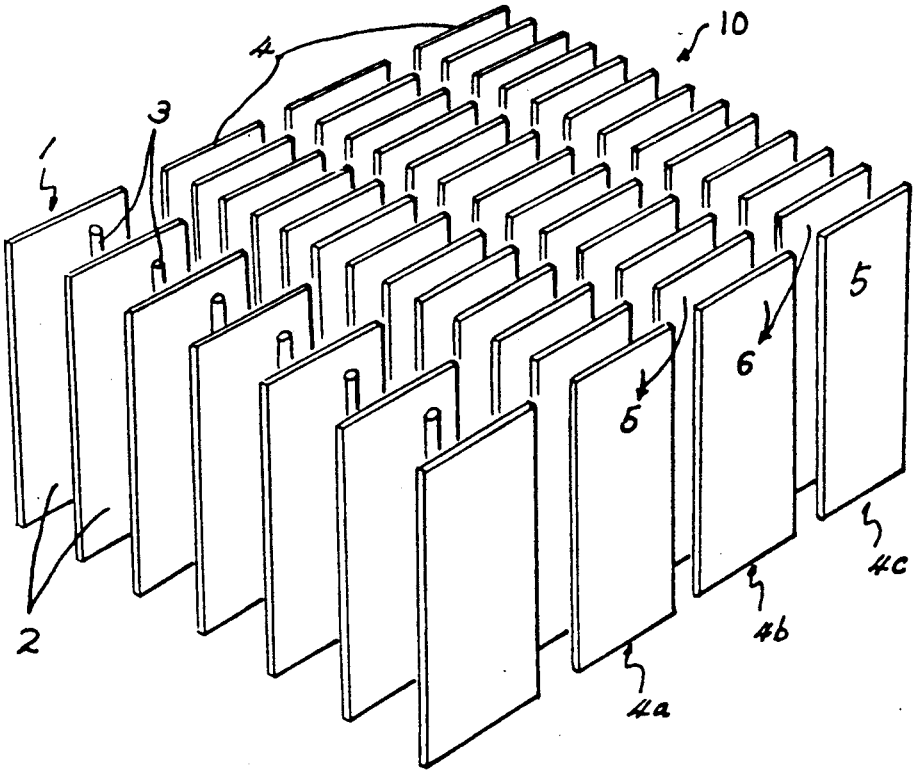
FIG. 2 is a perspective view of the arrangement of plate electrodes in an electrostatic precipitator according to the present invention.
Figure 3:
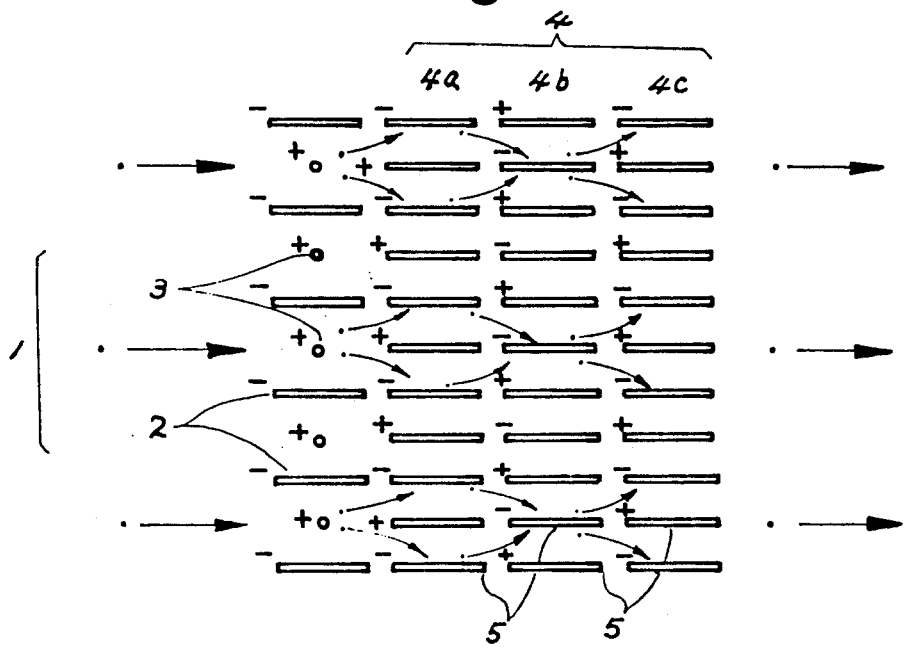
FIG. 3 is a top plan view of the arrangement of plate electrodes as seen in FIG. 2.

Referring to FIGS. 2 and 3, an electrostatic precipitator 10 includes a corona discharging section 1 and a dust collecting section 4. Said corona discharging section includes a plurality of collecting plate electrodes 2 biased at a negative potential and a plurality of wire electrodes 3 biased at a positive potential for charging dust particles. The wire electrodes 1 and collecting plate electrodes 2 are alternately arranged such that wire electrode 1 is disposed between two adjacent collecting plate electrodes 2 at equal spacing. Said dust collecting section 4 includes three sets 4*a*, 4*b* and 4*c* each of which comprises auxiliary plate electrodes 5 biased at a positive potential and collecting plate electrodes 6 biased at a negative potential. In the first set 4*a*, the plate electrodes 5 and 6 are arranged such that the auxiliary plate electrode 5 is aligned with collecting plate electrode 2 of the corona discharging section 1 and then the collecting plate electrode 6 is also aligned with the wire electrode 3. The arrangement of plate electrodes 5 and 6 in the second set 4*b* is opposite to that in the first set 4*a*, but the plate electrodes 5 and 6 in the third set 4*c* is in the same order as those in the first set 4*a*. The auxiliary plate electrodes 5 in the sets serve to accelerate the charged dust particles to the collecting plate electrodes 6. The equally spaced plate electrodes 5 and 6 in the sets 4*a*, 4*b* and 4*c* are disposed parallel to the direction of air flow through the electrostatic precipitator. The sets 4*a*, 4*b* and 4*c* are aligned with each other.

The dust particles carried by the introduced air stream as, they pass through the corona discharging section 1, are charged at positive potential and then move, in a wave motion, as depicted by the arrows in FIG. 3 under action of the attraction force of collecting plate electrodes 6 and exclustion force of auxiliary plate electrodes 5 to provide longer dust particle residence time in the collection area. Therefore, the dust particles can be effectively collected by the collecting plate electrodes 6.

In one possible embodiment of the present invention a houshold electrostatic precipitator is constructed with the distance between the wire electrode 3 and plate electrodes 5 and 6 in the firt set 4*a* is 16 mm and the distance between the plate electrodes 5 and 6 in each set is 3.6 mm. The distance between the sets of plate electrodesis 16 mm. When the introduced air stream velocity is 1.2 m/s to 1.5 m/s, 3.3 KV may be applied to the electrostatic precipitator.

Figure 4:
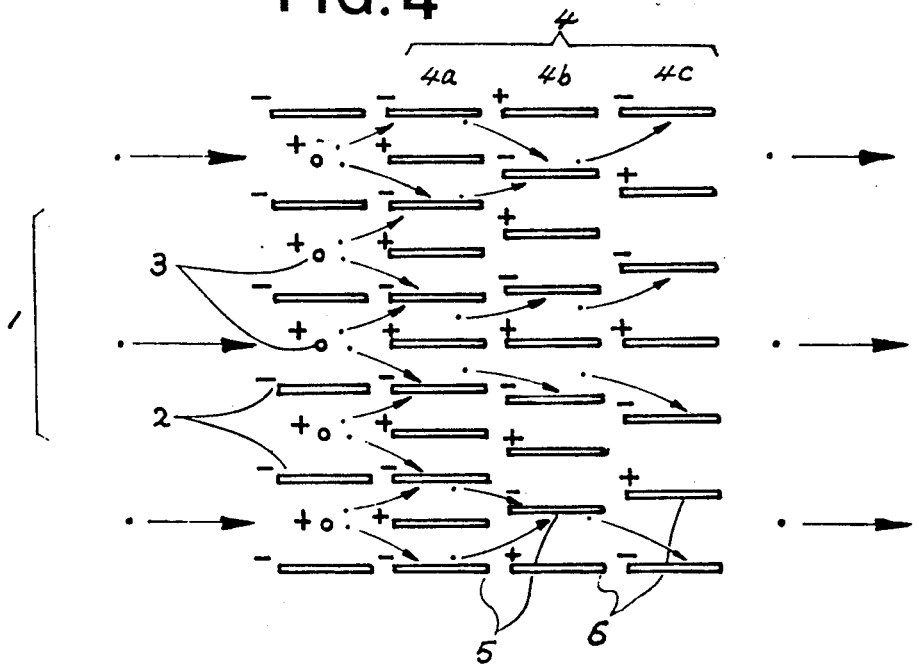
FIG. 4 shows the arrangement of plate electrodes of an alternate embodiment of the present invention.

To enhance the performance of an electrostatic precipitator in the collection of dust, as shown in FIG. 4, the distance between the plate electrodes 5 and 6 in a downstream set is greater than that in an upstream set, while a higher voltage is applied to the plate electrodes in a downstream set. For example, the distance between the plate electrodes 5 and 6 in the set 4*c* may be increased by 7.2 mm and then the applying voltage is also increased in proportion to the increase of distance between the plate electrodes 5 and 6 in a downstream set.

While the invention has been particularly shown and described with reference to preferred embodiments thereof, it will be understood by those skilled in the art that the foregoing and other changes in form and details can be made therein without departing from the sprit and scope of the invention.

What is claimed is:

1. An electrostatic precipitator including a corona discharging section for charging dust particles in the air flow introduced therein and having a plurality of parallel collecting plate electrodes and plurality of corona discharge electrodes each of which is disposed between the two adjacent collecting plate electrodes and a dust collecting section having a plurality of plate electrodes spaced apart at equal distance and disposed parallel to the direction of air flow, wherein said dust collecting section comprises at least two sets each of which includes a plurality of collecting plate electrodes biased at a negative potential and a plurality of auxiliary plate electrodes biased, at a positive potential, for serving to accelerate the positively charged dust particles to the collecting plate electrodes, wherein said collecting plate electrodes and auxiliary plate electrodes in each set are alternately arranged in parallel, and the sets of plate electrodes are aligned with each other such that the arrangement of collecting plate electrodes and auxiliary plate electrodes in one set is opposite to that in the adjacent sets whereby the positively charged dust particles passing through the collecting section are effectively collected to the collecting plate electrodes with a wave motion.

2. An electrostatic precipitator as defined in claim 1, wherein a higher voltage is applied to the plate electrodes in a downstream set than those in an upstream set.

3. An electrostatic precipitator as defined in claim 1, or 2 wherein the distance between the collecting and auxiliary plate electrodes in a downstream set is greater than that in an upstream set.

* * * * *